United States Patent [19]

Lautenschläger

[11] 4,123,823

[45] Nov. 7, 1978

[54] OVER-CENTER HINGE

[75] Inventor: Gerhard W. Lautenschläger, Brensbach, Fed. Rep. of Germany

[73] Assignee: Karl Lautenschläger KG Möbelbeschlagfabrik, Reinheim, Fed. Rep. of Germany

[21] Appl. No.: 845,964

[22] Filed: Oct. 27, 1977

[30] Foreign Application Priority Data

Dec. 11, 1976 [DE] Fed. Rep. of Germany ..... 2656305

[51] Int. Cl.[2] ..... E05D 11/10; E05D 3/06

[52] U.S. Cl. ..... 16/145; 16/163

[58] Field of Search ..... 16/145, 147, 163, 164, 16/180, 182, 183, 50

[56] References Cited

U.S. PATENT DOCUMENTS

| | | | |
|---|---|---|---|
| 3,564,643 | 2/1971 | Salice | 16/163 |
| 4,050,116 | 9/1977 | Salice | 16/163 |

FOREIGN PATENT DOCUMENTS

| | | | |
|---|---|---|---|
| 2,536,744 | 6/1976 | Fed. Rep. of Germany | 16/145 |
| 2,516,084 | 10/1976 | Fed. Rep. of Germany | 16/163 |
| 2,616,570 | 1/1977 | Fed. Rep. of Germany | 16/164 |

*Primary Examiner*—James Kee Chi

[57] ABSTRACT

An over-center hinge for cabinet doors, having two links in the manner of a quadruple joint, hinged at one end to a door member and at the other end to a wall member in the form of an elongated bearing arm, the links being movable through a dead-center position in the movement from the closed position to the open position, on the first side of which it is urged by the tension of a resilient element in the closing direction, and beyond which it is urged by the tension of the resilient element in the opening direction. The resilient element is disposed in the front, door-end portion of the bearing arm engaging with one end a projection at the bearing arm end of one of the links, which projection forms with the pivot axis of this link at the bearing arm end a lever arm which is so directed away from the pivot axis that it is biased by the resilient element in the hinge-closed position to a movement in the closing direction, and in the hinge-open position to a movement in the opening direction. The projection is provided on the outer link more remote from the bearing wall, and the resilient element has at least one helical spring constructed as a compression spring which is disposed under bias in the hollow interior of a thimble which is displaceable in an upper opening of the bearing arm with its open end facing the cabinet interior, and which at its extremity at the open end of the thimble engages the bearing arm.

9 Claims, 3 Drawing Figures

OVER-CENTER HINGE

BACKGROUND

The invention relates to an over-center hinge for cabinet doors, having two links hinged at one end to a door member and at the other end to a wall member in the form of an elongated bearing arm, in the manner of a quadruple joint, the said links being movable through a dead-center position in the movement from the closed position to the open position, on the first side of which it is urged by the tension of a resilient element in the closing direction, and beyond which it is urged by the tension of the resilient element in the opening direction, the resilient element disposed in the front, door-end portion of the bearing arm engaging with one end a projection at the bearing arm end a lever arm which is so directed away from the pivot axis that it is biased by the resilient element in the hinge-closed position to a movement in the closing direction, and in the hinge-open position to a movement in the opening direction.

Such over-center hinges, which are urged by spring tension into two stable end positions, have the advantage that a door mounted on a cabinet with such a hinge does not stop in intermediate positions, i.e., with the door ajar, and cannot be damaged by drawers in the cabinet, such as drawers for pots, supplies, or swing-out kitchen appliances in kitchen cabinets. An over-center hinge of this kind is known (German Offenlegungsschrift No. 21 17 828) in which a V-shaped leaf or wire spring is used to produce the spring tension, the spring being so disposed that the apex of the V-shaped spring passes around the pivot pin provided on the bearing arm side of the outer hinge link facing away from the bearing wall, while the free end of one of the spring legs engages a projection in the bearing-arm end of the other hinge link, while the second spring leg thrusts directly or indirectly against the bearing arm. On account of the limited space available, the production of a sufficiently great spring force by such V-shaped springs is difficult, and, especially when hairpin springs formed from spring steel wire are coiled about several times at the apex are involved, their installation is complicated. Consequently, over-center hinges of this kind have not found a market.

THE INVENTION

The invention, however, is addressed to the problem of creating an over-center hinge of the kind here involved, which will reliably move even heavy doors to the end positions with the required bias power, while at the same time being of simple construction, and enabling the resilient element to be installed and removed simply and quickly and to be manufactured economically.

Setting out from a hinge of the kind described in the beginning, this problem is solved in accordance with the invention in that the projection is provided on the outer hinge link that is farthest from the bearing wall, and that the resilient element has at least one helical spring constructed as a compression spring, which is disposed under bias in the hollow interior of a thimble which is displaceable in an upper opening in the bearing arm with its open end facing the cabinet interior, and which at its extremity at the open end of the thimble engages the bearing arm. The simply constructed and therefore inexpensive resilient element is thus disposed in a space-saving manner in the opening in the bearing arm, and is simple to install by compressing the commercially available coil springs contained in the thimble and inserting the thimble between the bearing arm and the projection on the hinge link.

In order to conceal the opening in the bearing arm, provision is made in further development of the invention for the thimble to substantially fill the opening in the bearing arm and slightly overreach the unpierced portion of the bearing arm.

In a preferred further development of the invention, two helical springs disposed parallelly side by side are provided in the thimble, while their ends facing the cabinet interior thrust against the edge of the bearing arm which defines the opening in said bearing arm and abuts the said springs. The doubling of the compression springs permits the spring force to be increased by using helical springs of smaller diameter, thereby enabling the thimble to be made relatively flat and compact.

To steady the thimble on the bearing arm, the edge of the opening in the latter which is engaged by the helical springs is provided with a tab bent down toward the interior of the bearing arm. Thus the entire end spiral of each spring rests against this tab.

At the end of the thimble facing the projection on the hinge link, the thimble is advantagously provided with a recess in which the free end of the projection of the link is supported. The projection is thus held in this recess only by the force of the springs. It is particularly economical to make this thimble of injection molded plastic. By metalizing at least the portion of it that is visible in the opening of the bearing arm, the appearance of the thimble can be made to match that of the bearing arm, so that it is barely noticeable to the eye.

Alternatively, the thimble can be made of metal by die casting.

The invention is further explained in the description that follows of an embodiment thereof, in conjunction with the appended drawings, wherein.

Figure 1:
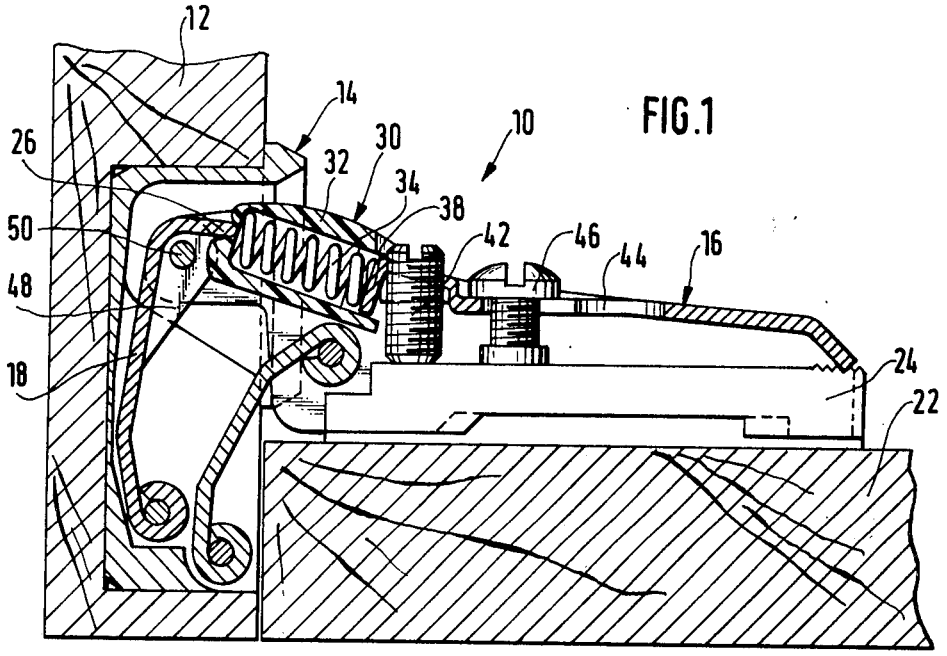
FIG. 1 is a cross-sectional view taken through the longitudinal central axis of an embodiment of the over-center hinge of the invention in the closed position.
Figure 2:
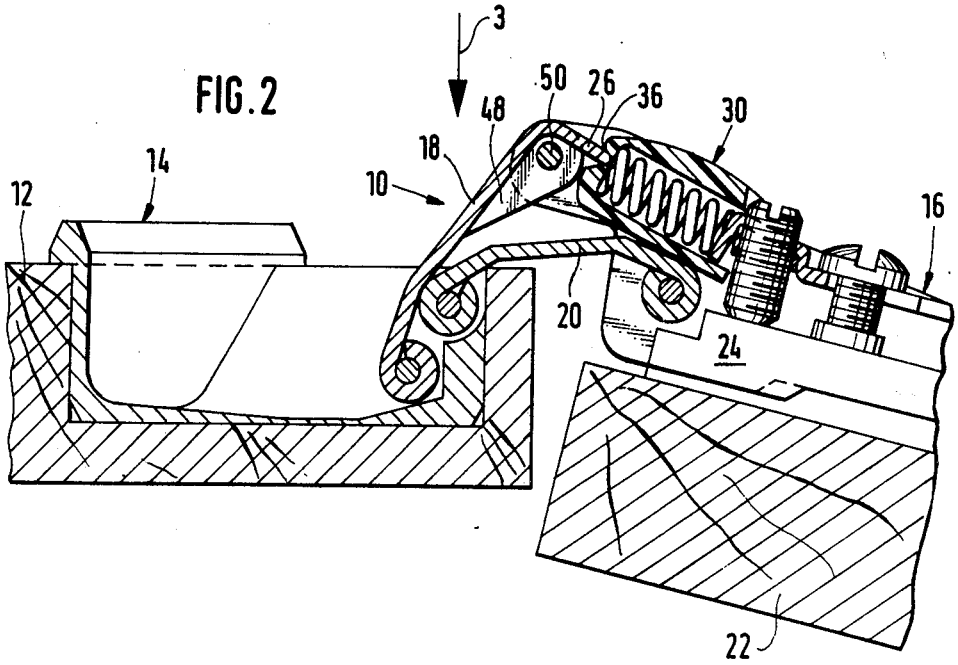
FIG. 2 is a cross-sectional view corresponding to FIG. 1 with the hinge in the open position.
Figure 3:
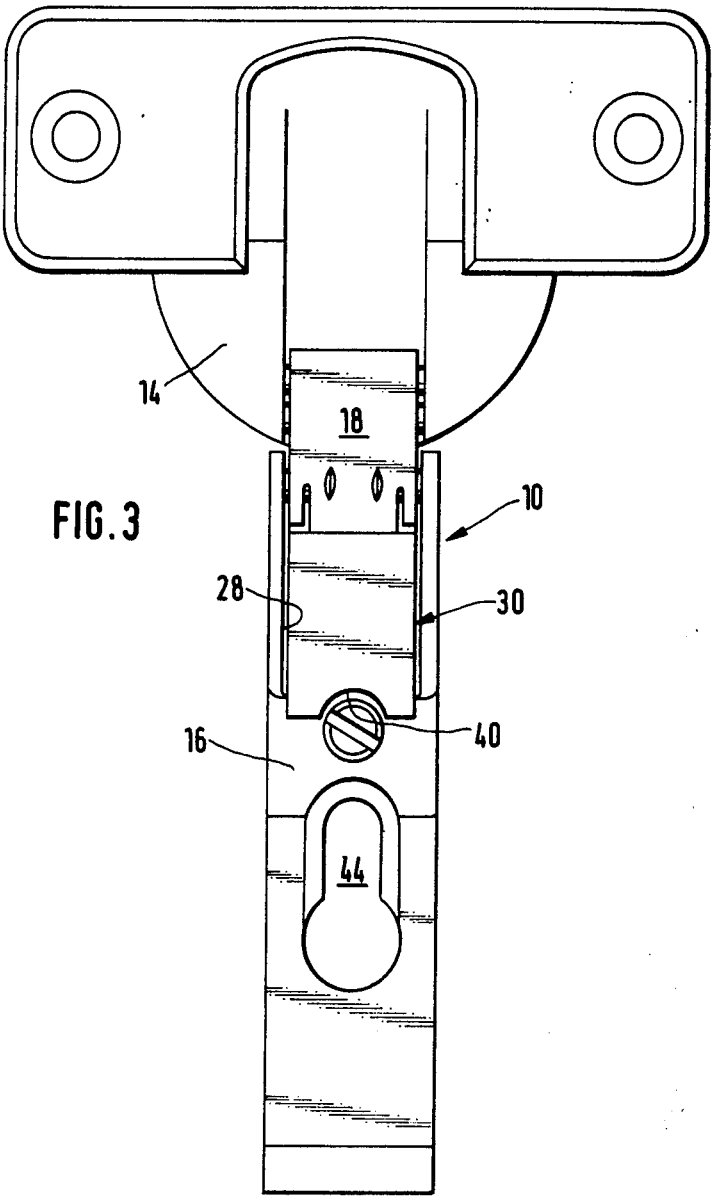
FIG. 3 is a top plan view of the over-center hinge of FIGS. 1 and 2, as seen in the direction of the arrow 3 of FIG. 2.

The hinge of the invention, generally designated by the number 10 in FIGS. 1 to 3, is a quadruple joint hinge in which the door member, which is inserted in a mating recess in the cabinet door 12 and is constructed as a hammer-in or snap-in cup 14, is articulated to the wall member, which is in the form of an elongated bearing arm 16, by means of two links 18 and 20. The attachment of the bearing arm 16 to the side wall 22 of the cabinet is accomplished in a known manner by means of a mounting plate 24 fastened to the side wall 22. Up to this point, the hinge 10 corresponds to conventional quadruple joint hinges.

The over-center mechanism of hinge 10 has a projection 26 on the bearing-arm end of the link 18, and a resilient element 30 disposed in an opening 28 in the top side of the bearing arm 16, the said resilient element 30 consisting in the illustrated case of a thimble 32 made of plastic, and of two helical springs 34 disposed parallelly side by side in the thimble under compressive bias. The closed end of the thimble is provided externally with a trough-like, transversely disposed recess 36 which is engaged by the free end of the projection 26, while the extremities of the helical springs 34 at the open end of the thimble engage a tab 38 bent down into the interior of the bearing arm from the support arm edge defining the opening 28. The trough-like recess 36 is preferably made so deep that at its bottom it just breaks through into the hollow interior of the thimble 32. The projection 26 of the link 18 thus abuts directly on the innermost spirals of the springs 34, so that there is no wear on the thimble within the recess 36. At its rearward end, the upper and lower sides of the thimble 32 are slightly lengthened, so that the thimble slightly overreaches the top and bottom of the tab 38 and is guided in this area by the said tab.

The semicircular notch 40 in the upper, lengthened portion of the thimble 32, which can be seen in FIG. 3, permits access to a tap underneath it in the bearing arm, which serves to accommodate a set screw 42 whereby the setting of bearing arm 16 relative to the mounting plate 24 can be varied. The fastening of the bearing arm 16 on the mounting plate 24 so as to be adjustable longitudinally is accomplished conventionally by means of the fastening screw 46 shown in FIG. 1, which passes through an elongated slot 44 in the bearing arm 16 and is threaded into the mounting plate 24.

The projection 26 of the link 18 is so directed relative to the axis on which said link 18 pivots on bearing arm 16 that the resilient forces exercised on it by the helical springs 34 through the thimble 32 produce a torque which seeks to swing the link in the closing direction when it is in the closed position (FIG. 1) and to swing it in the opening direction when it is in the open position (FIG. 2).

For its attachment to the bearing arm, the link 18 has in its terminal portion two lateral cheeks 48 bent at right angles, in which bearing bores are provided for the corresponding hinge pin 50 riveted in the bearing arm and forming the axis for the hinge link. The otherwise conventional rolled bearing eye is thus replaced in the present case by the bearing bores in the cheeks 48, so that the material otherwise used to form the bearing eye can be used for the formation of the projection 26.

I claim:

1. An over-center hinge for cabinet doors, having two links in the manner of a quadruple joint, to be hinged at one end to a door member of the cabinet and at the other end to a wall member of the cabinet in the form of an elongated bearing arm, said hinge being movable through a dead-center position in the movement from a closed position to an open position, a resilient element for urging said hinge on the one side of said dead-center position in the closing direction, and on the other side in the opening direction, said bearing arm having a front, door-end portion, one of said links having a lever-like projection at that end thereof which is adjacent the bearing arm, said projection having a free end, said resilient element being disposed in said front, door-end portion of the bearing arm and engaging with one end said free end of said projection, said projection forming with the pivot axis of said one link, at the bearing arm end a lever arm which is so directed away from said pivot axis that it is biased by said resilient element in the closed position to a movement in the closing direction, and in the open position to a movement in the opening direction, said projection being provided on that link of said two links which is more remote from said wall member, said resilient element having at least one helical spring constructed as a compression spring, said bearing arm having an opening in its upper face, a thimble displaceable in said opening in the direction of the longitudinal extension of said bearing arm, said thimble having a hollow interior and having an open end facing the cabinet interior, said spring being disposed under bias in said hollow interior of said thimble, said spring with its extremity at the open end of said thimble engaging said upper face of said bearing arm while said thimble engages said free end of said projection.

2. The over-center hinge of claim 1, wherein said thimble substantially fills said opening in said bearing arm and, at its extremity pointing to the cabinet interior extending partially around an unpierced portion of said bearing arm.

3. The over-center hinge of claim 1, wherein two helical springs are disposed parallel, and side by side in said thimble, the extremities of said two helical springs pointing to the cabinet interior bearing against the bearing arm edge which faces the same and defines said opening in said bearing arm.

4. The over-center hinge of claim 3, wherein said edge is provided with a short tab turned down and pointing into the interior of said bearing arm and receiving the thrust of said helical springs.

5. The over-center hinge of claim 1, wherein said thimble end facing said projection of said more remote link has a recess in which the free end of said projection is supported.

6. The over-center hinge of claim 5, wherein said recess in said thimble is trough-shaped and extends parallel to the bearing arm end pivot axis of said more remote link on the bearing arm, and wherein said recess is of such depth that it has at the bottom of the trough a narrow opening into the hollow interior of the thimble which accommodates said helical springs.

7. The over-center hinge of claim 1, wherein said thimble is injection molded of plastic.

8. The over-center hinge of claim 7, wherein at least the upper side of said thimble which is visible in said opening in the bearing arm is metallized.

9. The over-center hinge of claim 1, wherein said thimble is a die-cast metal part.

* * * * *